US006015526A

United States Patent [19]

Ruiter

[11] Patent Number: 6,015,526

[45] Date of Patent: Jan. 18, 2000

[54] VERTICAL ANNEALING FURNACE FOR A STRIP TREATMENT DEVICE

[75] Inventor: Leo Antonius Ruiter, Krimpen a/d IJssel, Netherlands

[73] Assignee: Thermtec B.V., Rotterdam, Netherlands

[21] Appl. No.: 09/170,522

[22] Filed: Oct. 13, 1998

Related U.S. Application Data

[63] Continuation of application No. PCT/NL97/00181, Apr. 9, 1997.

[30] Foreign Application Priority Data

Apr. 12, 1996 [NL] Netherlands ..... 1002856

[51] Int. Cl.[7] ..... C21D 9/54

[52] U.S. Cl. ..... 266/108; 266/103

[58] Field of Search ..... 266/78, 90, 96, 266/99, 108, 103

[56] References Cited

U.S. PATENT DOCUMENTS

| | | | |
|---|---|---|---|
| 2,594,876 | 4/1952 | Cope . | |
| 3,711,073 | 1/1973 | Chu et al. | 266/108 |

FOREIGN PATENT DOCUMENTS

| | | |
|---|---|---|
| 0 675 208 | 10/1995 | European Pat. Off. . |
| 652 552 | 11/1937 | Germany . |
| 38 09 516 | 10/1989 | Germany . |
| 02 282687 | 2/1991 | Japan . |
| 4-225780 | 8/1992 | Japan . |
| 6-207783 | 11/1994 | Japan . |
| 357 575 | 9/1931 | United Kingdom . |

OTHER PUBLICATIONS

Stahl Und Eisen, vol. 93, No. 24, Nov. 22, 1973, pp. 1152–1157 H.W. Honervogt: "Eine indirekt beheizte Gluhanlage fur das Gluhen von nichtrostenden und saurebestandigen Kaltbandern unter Schutzgas".

*Primary Examiner*—Scott Kastler
*Attorney, Agent, or Firm*—Thomas R. Vigil

[57] ABSTRACT

The vertical annealing furnace for the continuous bright annealing of a metal strip guided through the furnace comprises: a vertically disposed muffle having a strip entry side and a strip exit side, the muffle having the freedom to expand in a longitudinal direction, and the muffle being disposed such that the strip entry side is situated at a top side of the muffle and the strip exit side is situated at an underside of the muffle; heating structure for externally heating the muffle; bearing structure for fixedly supporting the underside of the muffle such that it is delimited downwards in the longitudinal direction; an expansion section being provided on the top side of the muffle for taking up thermal expansion in the longitudinal direction of generally the entire muffle; and vertically movable support structure for exerting an upwardly directed support force on the muffle, the vertically movable support structure being connected to an upper part of the muffle.

10 Claims, 3 Drawing Sheets

VERTICAL ANNEALING FURNACE FOR A STRIP TREATMENT DEVICE

CROSS-REFERENCE TO RELATED APPLICATIONS

This is a continuing application of PCT/NL97/00181 filed Apr. 9, 1997.

BACKGROUND OF THE INVENTION

1. Field of the Invention

The invention relates to a vertical annealing furnace for the continuous bright annealing of metal strip guided through the furnace, comprising a vertically disposed muffle having a strip entry side and a strip exit side, as well as heating means for externally heating the muffle, the muffle having the freedom to expand in the longitudinal direction.

2. Description of the Prior Art

A vertical annealing furnace of this kind is known, inter alia, from Stahl und Eisen, Volume 93, No. 24, of Nov. 22, 1973, pp. 1152–1157. In this case, the muffle comprises a top flange, by means of which it is suspended fixedly in a frame. The muffle can expand freely downwards, in the longitudinal direction, with respect to the rest of the annealing furnace. This possibility of expansion of the muffle is of crucial importance in order to be able to achieve a specific large structural height (e.g. 20 m) of the annealing furnace. This is because, in the case of so-called bright annealing of stainless steel strip, the temperature of the muffle is in the region of 1150° C. At such a high temperature, the expansion of the muffle in the longitudinal direction is very great. If no provisions were then to be made permitting this expansion, this would lead to bending deformations of the muffle, both in the transverse and in the longitudinal direction of the muffle. The strip to be heated passes through the muffle from the bottom to the top. The point where the strip reaches its highest temperature in the muffle is therefore situated at the top of the muffle. In order to guide the strip through the muffle and to be able to hold the strip at a specific stress, a specific strip tension is exerted on the strip, this tension being transmitted to the strip by means of rollers. Downstream of the muffle is situated a cooling section, which, owing to the high final temperature which the strip has reached at the end of the muffle, should be placed directly after the strip exit side of the muffle. As a result, the cooling section is situated entirely or mostly directly above the vertically disposed muffle.

A vertical annealing furnace of the same kind is also known from JP-A-2 282 687 and JP-A-4 225 780. These furnaces are furthermore provided with counterweight mechanisms giving a compression load acting on the lower part of the muffle. Thus downward directed focus caused by the muffle weight and thermal expansion of the muffle are reduced.

A drawback of these known vertical annealing furnaces is that the structural height is limited. There are two reasons for this limitation of the structural height. Firstly, the full weight of the muffle is suspended from the top flange, which means that the maximum permissible stress for the muffle material in the region of the top flange is decisive for the maximum permissible muffle weight suspended therefrom. It may be noted at this point that, in these known annealing furnaces where the strip runs through the muffle from the bottom to the top, the muffle is exposed in its upper section to high temperatures, because this is where the strip to be heated has to reach its final temperature. This high temperature in the upper section of the muffle reduces the maximum permissible tensile stress. In order nevertheless to achieve structural heights of 22–24 m, the thickness of the muffle wall has to increase progressively towards the top, so as not to exceed the tensile stress which is permissible for the muffle material. Secondly, the hottest point of the strip is likewise situated at the top side of the muffle. This most critical point of the strip is as a result subjected to relatively heavy loads due to the inherent weight of the strip situated beneath it and due to the strip tension exerted on the strip. This too entails limitations for the maximum height to which a vertical annealing furnace of this kind can be built. This is because if the furnace is too high, the strip will yield at the weakest point, that is to say at the top side of the muffle. The furnaces as disclosed in JP-A-2 282 687 and JP-A-4 225 780 have the further disadvantage that the counterweight mechanisms counteract the expansion of the muffle. All this places limitations on increasing the production capacity, since building a higher muffle annealing furnace is limited in technical terms.

SUMMARY OF THE INVENTION

The object of the present invention is to provide a vertical muffle annealing furnace in which a much greater structural height and/or production capacity can be achieved.

This object is achieved according to the invention by a vertical annealing furnace for the continuous bright annealing of metal strip guided through the furnace, comprising a vertically disposed muffle having a strip entry side and a strip exit side, as well as heating means for externally heating the muffle, the muffle having the freedom to expand in the longitudinal direction, in which the muffle is disposed such that the strip entry side is situated at the top side and the strip exit side is situated at the underside, the underside of the muffle being fixedly supported such that it is delimited downwards in the longitudinal direction and an expansion section is provided on the top side of the muffle for taking up thermal expansion in the longitudinal direction of mainly the entire muffle, the upper part of the muffle being connected to vertically movable support means for exerting an upwardly directed support force on the muffle. In a vertical annealing furnace of this kind, the strip passes through the muffle from the top to the bottom. As a result, the hottest point of the strip is situated at the bottom of the muffle, so that this most critical point in the strip is subjected to minimum load from its own weight. As a result, it is advantageously possible to construct a higher vertical annealing furnace, as a result of which a higher production capacity can be achieved. If, in this structural form, the known fixed suspension of the muffle from its top side should continue to be chosen, i.e. with the possibility of expanding downwards, the need would arise to provide a very gastight and high-temperature-resistant expansion section between the strip exit side of the muffle and the cooling section situated beneath the latter, or else possibly to allow the whole of the cooling section to move together with the muffle. In construction terms, it is scarcely possible to realize either solution, and even if it were possible, this would be extremely expensive. According to the invention, the muffle can expand upwards in the longitudinal direction. This is advantageous, because the cooling section can then be placed directly beneath the muffle without having to provide particular measures for taking up the expansion of the muffle in this transition region, which is critical for the annealing process. The necessary expansion section can now advantageously be arranged at the top side of the muffle, in the relatively cold section. The top side of the muffle is connected to support means for exerting an upwardly directed support force on the muffle. As a result, it is advantageously possible to relieve the stress to a considerable extent on the most critical point of the muffle, namely the part in the region of the strip exit side, where the highest temperature is required, and advantageously even to keep it virtually free from stress.

It is noted that U.S. Pat. No. 2,594,876 discloses an apparatus for carburizing steel strip, comprising a vertically disposed muffle furnace. The muffle furnace has a strip entry side at the top and a strip exit side at the bottom, so steel strip to be treated runs in a continuous process through the muffle in a downward direction. Heating means are provided for externally heating the muffle. However, U.S. Pat. No. 2,594,876 does not show or mention provisions for the weight and expansion problems of the muffle. Instead, the muffle is reinforced and supported by structural steel members and supported thereby on the floor. This is why the maximum possible structural height and operating temperature for this known type of muffle furnace are very limited, thus making it impossible to further increase the production capacity and to perform heat treatments at higher temperatures.

BRIEF DESCRIPTION OF THE DRAWINGS

The invention will be explained in more detail with reference to the accompanying drawing, in which.

DESCRIPTION OF THE PREFERRED EMBODIMENTS

Figure 1:
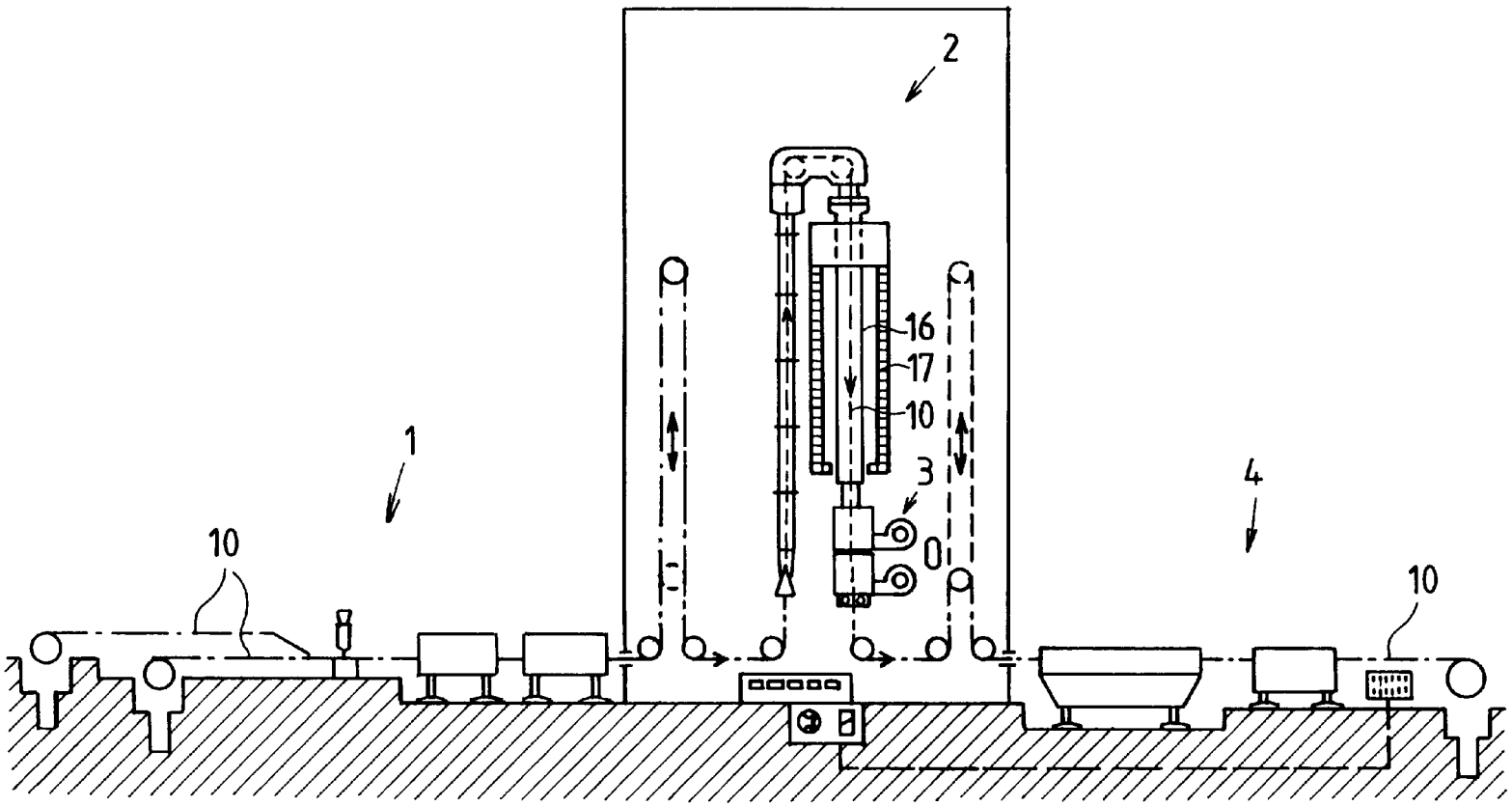
FIG. 1 is a diagrammatic depiction of a strip treatment device having a vertical annealing furnace according to the invention.

In the embodiment shown in FIG. 1 of a strip treatment device having a vertical annealing furnace, it is possible to distinguish substantially four sections, namely a strip feed section 1, a heating section 2, a cooling section 3 and a strip removal section 4. In the strip feed section, metal strip 10, in particular stainless steel strip, is fed in, on which strip, if desired, a number of operations may additionally be carried out, such as, for example, welding or degreasing. The strip 10 then passes into the heating section 2, where the strip is annealed, preferably free from oxidation, in a vertical annealing furnace. Otherwise, oxidation of the strip during the annealing treatment would produce discoloration and a loss of quality, and can be prevented by carrying out the annealing of the strip in a chamber filled with protective gas. The heating section 2 comprises, in a known manner, a so-called vertical muffle furnace. This muffle furnace is provided with a long cylindrical muffle 16, which is enclosed by a case 17, in which heating means are disposed which externally heat the muffle 16. In turn, the muffle 16 heats the strip 10 which is fed through it. This indirect heating of the strip 10 is characteristic of a muffle furnace. Advantageously, at least the muffle 16 is filled with protective gas. After the strip 10 has been annealed in the muffle furnace, it has to be cooled very rapidly to a predetermined low temperature. This takes place in the cooling section 3. Finally, the strip 10 passes into the strip removal section 4, where it can, for example, be aftertreated, inspected and wound up.

According to the invention, the muffle furnace is disposed such that the strip 10 to be annealed is introduced at the top side of the muffle 16 and is discharged at the underside of the muffle 16. As a result, the hottest, and therefore most critical, point of the strip is situated at the bottom of the muffle 16. This has the major advantage that the hottest point of the strip 10 is subjected to relatively little load from its own weight, as a result of which its inherent strength at this most critical point of the strip 10 will be exceeded less rapidly. As a result, the muffle furnace may be of higher design and the strip passage rate can be increased, as a result of which it is possible to achieve greater production.

Since the muffle reaches very high temperatures, it will expand considerably in the longitudinal direction. This expansion is taken up at the top side of the muffle by flexible means 18 which are suitable for this purpose.

Figure 2:
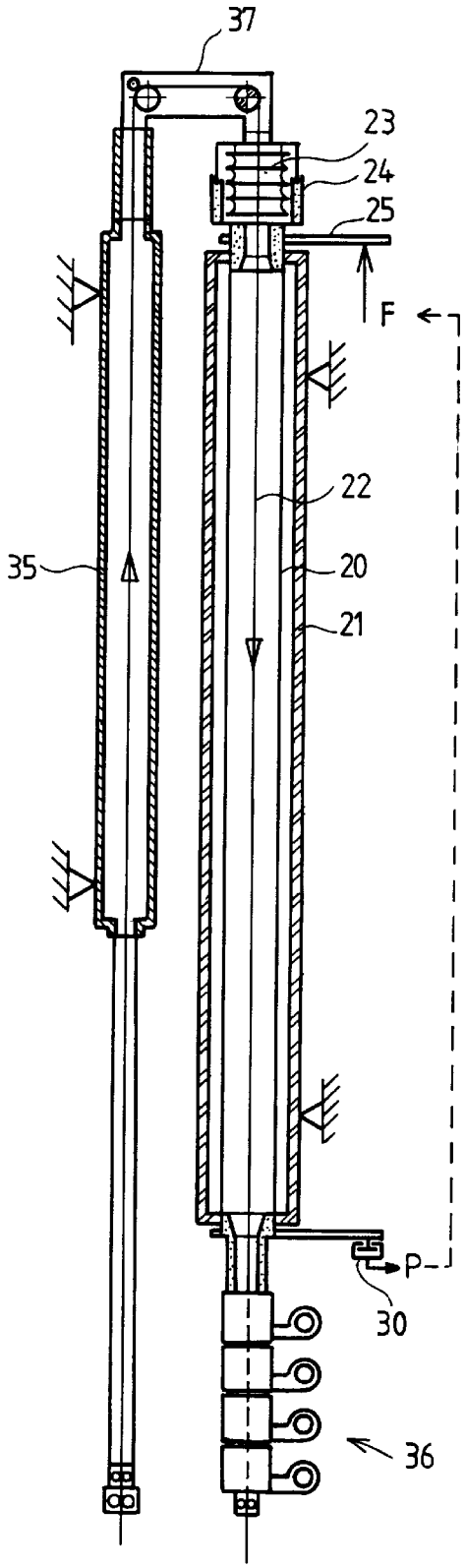
FIG. 2 is a cross-sectional view of a preferred embodiment of part of the strip treatment device of FIG. 1.

In the embodiment shown in FIG. 2 of the muffle furnace, the muffle 20 is suspended freely moveable within a case 21, such that the expansion can take place upwards. For this purpose, the muffle 20 is connected at the top to a flexible bellows structure 23. Advantageously, the bellows structure 23 is produced from a fabric expansion joint, which in particular comprises, for example, teflon-coated gastight cloths. This bellows structure 23 is so flexible that it can be compressed without large forces when the muffle 20 expands upwards. As stated, the annealing preferably takes place in a protective gas which, for example, comprises mainly hydrogen. The use of this protective gas should, for cost reasons, be kept as low as possible. Moreover, it is extremely hazardous if large quantities of protective gas could escape all at once. For this purpose, the bellows structure 23, which is inherently gastight, is incorporated, as an extra protection, in a steel box 24 which encloses a liquid seal.

Advantageously, the muffle 20 is connected at the top to support means 25 which exert an upwardly directed support force F on the muffle 20. As a result, the muffle 20 can be balanced such that the underside of the muffle 20, which is connected in a gastight manner to the cooling section situated beneath it, can be supported in a more or less "floating" manner. The upwardly directed support force F may, for example, be exerted by means of counterweights which are connected to the top side of the muffle 20. The loading of the muffle 20 may be influenced by making the said counterweights lighter or heavier. The advantage of the counterweights is that they are able to operate virtually without faults and maintenance. In another embodiment, the muffle 20 is suspended at the top in a frame which is displaceable in the vertical direction. By then connecting the muffle 20 at the bottom to a sensor 30, the downwards force exerted by the muffle 20 can be measured. In particular, control means may be provided for adjusting the support force F exerted by the support means 25 as a function of a value p measured by the sensor 30. If, for example, p passes beyond a specific minimum or maximum value, the frame can be displaced in the vertical direction until p returns to within the set limits. In the embodiment with the counterweights too, consideration may be given to adjusting the counterweights (making them lighter or heavier) as a function of p, which can be carried out either manually or automatically. An optimum loading condition for the muffle 20 can thus be maintained both using the vertically adjustable frame and using the counterweights. A mixed form of support means is also very readily possible. Consideration may be given to a stationary loading using counterweights on which an adjustable load is superposed. By dint of the expansion section at the top of the muffle and the balanced, adjustable supporting of the top side of the muffle, it is possible to keep the lower part of the muffle virtually free from stress. For this purpose, the support means compensate for the weight of the muffle and any other loads on the muffle (for example frictional forces which occur as a result of the expansion). Advantageously, the measuring means are situated at the bottom of the muffle, where the most critical section of the muffle is also situated. Due to the very low and readily measurable loading of the lower part of the muffle, if necessary it is even possible to allow a higher temperature in that region than in the prior art. This too may result in yet a further increase in the production capacity.

Figure 3:
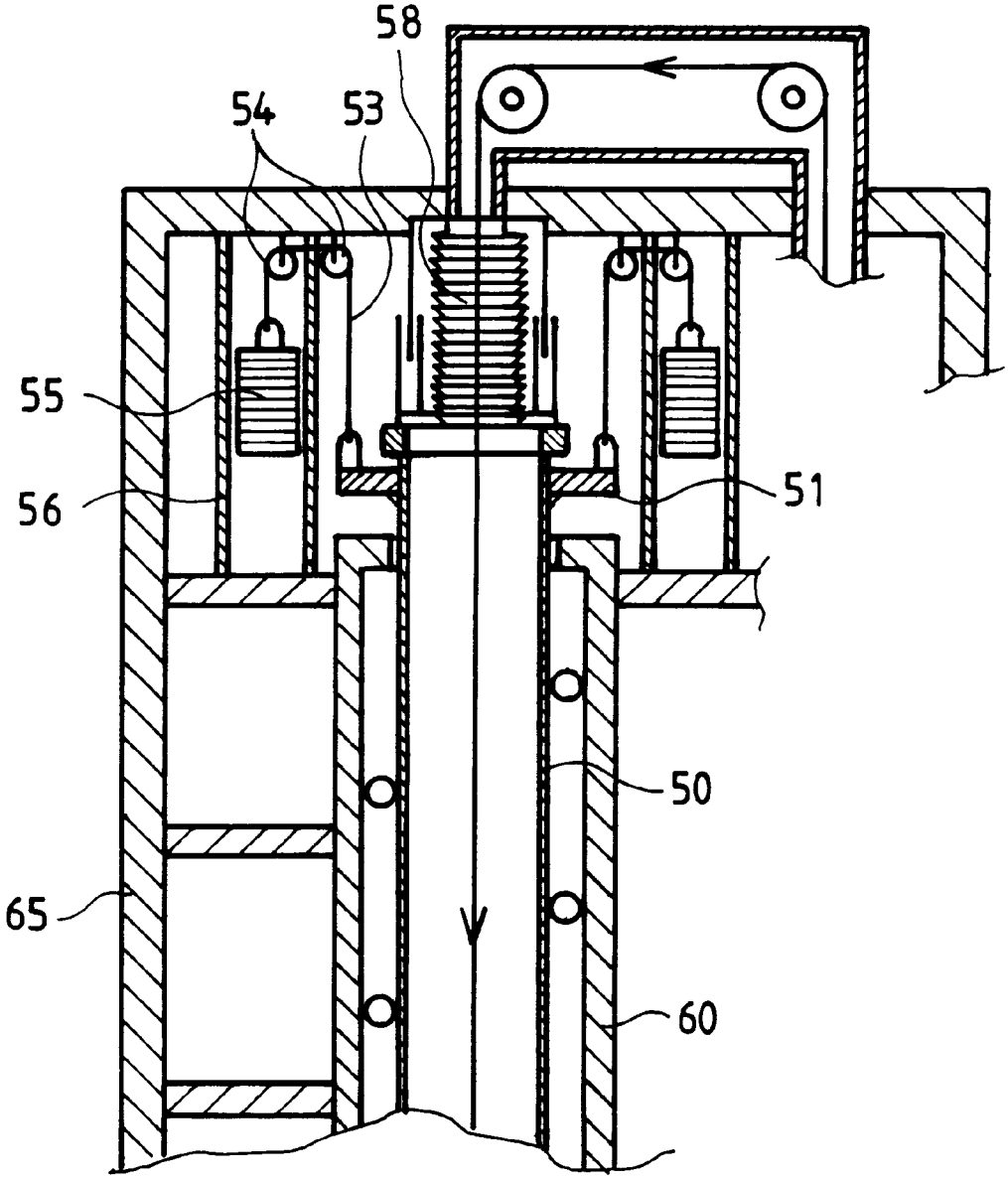
FIG. 3 shows, very schematically, an embodiment of the muffle support means with counterweights.

FIG. 3 shows an embodiment of the support means in the form of counterweights. For this purpose, a flange 51 is welded to the top section of the muffle 50. The flange 51 is connected to counterweights 55 via cables 53 and pulleys 54. The counterweights 55 thus exert an upwardly directed force on the muffle 50. If the muffle 50 expands upwards, the counterweights 55 can move downwards in their respective guides 56. At the same time, a bellows section 58, which is incorporated in a water seal, will be compressed. The case 60, the pulleys 54 and the top side of the bellows section 58 are fixedly connected to a frame 65 which is supported on the ground.

Due to the fact that the strip 22 passes through the muffle 20 from the top to the bottom, and therefore only has to reach its highest temperature in the lower part of the muffle, it is advantageously possible to select the temperatures to which the heating means heat the muffle 20 for the upper part of the muffle to be lower than those for the lower part of the muffle 20. This is because the upper part of the muffle 20 has to support virtually the entire inherent weight of the muffle 20. By selecting the temperature to be lower in that region, the muffle 20 can support a higher inherent weight at its upper part, as a result of which it is again possible to design the muffle furnace to be higher and thus to increase the production capacity considerably. The wall thickness of the muffle 20 will usually increase towards the top. By reducing the temperature in the upper part of the muffle 20, the wall thickness of the upper part does not have to increase, or has to increase to a lesser extent, and can nevertheless support a greater inherent weight.

It is possible to preheat the strip 22, in order to save energy and/or to achieve a further increase in production. The residual heat from the muffle furnace, for example, may be used for this purpose. To this end, in FIG. 2 a pre-heating section 35 is provided in the rising part of the strip 22. An upper chamber 37 with two top rollers for guiding the strip 22 is situated between the preheating section 35 and the bellows structure 23.

In order to be able to repair, maintain or replace the muffle 20, it is important for it to be possible to remove the latter from the case 21 rapidly and easily. To this end, the case 21 is provided with a removable cover plate either on the top or on the side. Due to the fact that the cooling section 36 is situated, according to the invention, at the underside of the muffle 20, it can advantageously remain in place. In the prior art, in which the cooling section is situated at the top side of the muffle, the cooling section first has to be dismantled before the muffle can be removed upwards out of the case. The muffle 20 in the vertical annealing furnace depicted in FIG. 2 can be replaced as follows. By placing the upper chamber 37 with the two top rollers on a movable frame, it can be moved sideways. The bellows structure 23, together with the steel box 24, can then be raised with the aid of hoisting means, so that the top cover of the case 21 is released. The cover is removed and the muffle 20 can be removed from the case 21, likewise with the aid of hoisting means.

The use, and therefore supply, of (expensive) protective gas with a high hydrogen content is expediently limited to the actual annealing process, that is to say to the chamber within the muffle and cooling section. In order to reduce losses of protective gas and to improve the process conditions, special seals are provided in the region of the strip entry side of the muffle and at the strip exit side of the cooling section. In the rising part of the heating section, if desired, inexpensive protective gas with a low hydrogen content can then be supplied. This protective gas substantially comprises, for example, nitrogen, and serves to flush off any contaminants which enter together with the strip. Due to the considerably increased production capacity and the associated higher strip speeds, it is of great importance, for the purpose of obtaining a good product, for the adhering layer of air to be removed from the strip surface before the strip is heated. In the muffle furnace proposed here, a long preflushing time is now advantageously available. With this a distribution of types of protective gas is accomplished which are to be supplied to various points over the heating section.

According to the invention, a vertical annealing furnace is thus obtained in which a high production rate can be achieved with low costs due to the fact that the muffle furnace can be made longer than in the prior art. Moreover, a very advantageous structure is provided for upwardly taking up the muffle expansion in the longitudinal direction.

I claim:

1. Vertical annealing furnace for the continuous bright annealing of a metal strip guided through said furnace, comprising:

a vertically disposed muffle having a strip entry side and a strip exit side, said muffle having the freedom to expand in a longitudinal direction, and said muffle being disposed such that said strip entry side is situated at a top side of said muffle and said strip exit side is situated at an underside of said muffle;

heating means for externally heating said muffle;

bearing means for fixedly supporting the underside of said muffle such that it is delimited downwards in the longitudinal direction;

an expansion section being provided on the top side of said muffle for taking up thermal expansion in the longitudinal direction of generally said entire muffle; and vertically movable support means for exerting an upwardly directed support force on said muffle, said vertically movable support means being connected to an upper part of said muffle.

2. Vertical annealing furnace according to claim 1 in which said support means for exerting the upwardly directed support force on said muffle are adjustable.

3. Vertical annealing furnace according to claim 1 in which said support means are adjustable such that the upwardly directed support force on said muffle substantially compensates for the weight of said muffle.

4. Vertical annealing furnace according to claim 1 in which said support means comprise counterweights.

5. Vertical annealing furnace according to claim 1 in which said support means comprise a vertically displaceable frame in which said muffle is suspended.

6. Vertical annealing furnace according to claim 1 in which the underside of said muffle is connected to a sensor for measuring the downward force exerted by said muffle.

7. Vertical annealing furnace according to claim 6 in which control means are provided for adjusting the support force exerted by said support means as a function of a value measured by said sensor.

8. Vertical annealing furnace according to claim 1 in which said muffle is connected on the strip entry side, to a bellows structure for the purpose of forming a flexible connection to means situated upstream thereof.

9. Vertical annealing furnace according to claim 1 in which said heating means are designed to allow the temperature of said muffle during operation to be lower at the strip entry side than at the strip exit side.

10. Strip treatment device comprising a strip feed section, a heating section having a vertical annealing furnace according to claim 1, a cooling section situated downstream thereof and a strip removal section.

* * * * *